US005531037A

United States Patent [19]

Pons et al.

[11] Patent Number: 5,531,037

[45] Date of Patent: Jul. 2, 1996

[54] WATER PROPORTIONING DEVICE FOR STEAM IRONS

[75] Inventors: Francesc Pons, Sant Just Desvern; Pedro Perez, Cornella; Augustin Auria, Esplugues de Llobregat, all of Germany

[73] Assignee: Braun Aktiengesellschaft, Frankfurt, Germany

[21] Appl. No.: 376,872

[22] Filed: Jan. 23, 1995

[30] Foreign Application Priority Data

Jan. 29, 1994 [DE] Germany ..... 44 02 683.8

[51] Int. Cl.[6] ..... D06F 75/18; F16K 5/10

[52] U.S. Cl. ..... 38/77.8; 251/208; 251/296

[58] Field of Search ..... 38/77.8, 77.5, 38/77.83; 251/208, 209, 296; 137/636.4; 219/245

[56] References Cited

U.S. PATENT DOCUMENTS

| | | | |
|---|---|---|---|
| 2,427,521 | 9/1947 | Butman et al. | 38/77.83 |
| 2,744,342 | 5/1956 | More | 38/77.83 |
| 3,165,843 | 1/1965 | Willman | 38/77.81 |
| 3,305,211 | 2/1967 | Phillips | 251/209 X |
| 4,296,560 | 10/1981 | Schwob | 38/77.83 |
| 4,669,207 | 6/1987 | Hennuy et al. | 38/77.8 X |
| 4,802,506 | 2/1989 | Aslanian | 251/209 X |

FOREIGN PATENT DOCUMENTS

| | | | |
|---|---|---|---|
| 0014643 | 8/1980 | European Pat. Off. . | |
| 2290524 | 11/1975 | France . | |
| 2337780 | 11/1976 | France . | |
| 278827 | 5/1990 | Germany | 38/77.83 |

*Primary Examiner*—Ismael Izaguirre
*Attorney, Agent, or Firm*—Fish & Richardson

[57] ABSTRACT

A water proportioning device for steam irons, has a valve (52) arranged between a water reservoir (1) and a steam-generating chamber (2). The valve includes a valve member (5) having a valve opening (7) and a valve pin (9) in sealing engagement within the valve opening (7) and provided with a longitudinal groove (15). The valve pin (9) is rotatable within the valve opening (7) and movable from a closed position into an open position and vice versa by a rotary motion. The valve member (5) includes a skirt (6) encompassing the valve pin (9) and having a radial opening (18). In the closed position, one end of the longitudinal groove (15) is within the skirt (6), while in the open position the end of the longitudinal groove (15) is in communication with the opening (18) in the skirt (6).

17 Claims, 3 Drawing Sheets

WATER PROPORTIONING DEVICE FOR STEAM IRONS

This invention relates to a water proportioning device for steam irons, with a valve arranged between a water reservoir and a steam-generating chamber and comprising a valve member having a valve opening and a valve pin in sealing engagement within the valve opening and provided with a longitudinal groove, the valve pin closing the valve opening in a first position and being movable into a second position in which the two ends of the longitudinal groove are open on either side of the valve opening.

BACKGROUND OF THE INVENTION

A water proportioning device for steam irons of the type initially referred to is known from EP-B-0 014 643. In this known device, the valve member of the first valve is comprised of an annular member of an elastomer material having on its inner wall a substantially radial, flexible lip providing the boundary for the valve opening. The valve pin is movable relative to the valve member only axially, providing three different positions in which the valve pin is adapted to be locked in place by means of a snap-in locking mechanism.

In one end position, the two ends of the longitudinal groove are on the same side of the valve opening, the valve pin then closing the valve opening. In a mid-position and in a second end position, the two ends of the longitudinal groove are on either side of the valve opening, with the area of cross-section of the longitudinal groove that lies within the lip defining the amount of water supplied to the steam-generating chamber. The longitudinal groove being correspondingly configured, this cross-sectional area differs in dimension in the two positions, that is, the mid-position and the second end position, enabling a larger or smaller amount of steam to be produced depending on the position selected. The capability of producing a surge of steam does not exist.

Further, from FR-B-2 337 780 a water proportioning device for steam irons is known in which the first valve is opened by turning the valve pin such that, in accordance with its open position, one or several bores provided on the valve pin engage a radial opening provided on the valve member, thus enabling metered amounts of water to be conducted from the water reservoir through the bores into a longitudinal bore disposed on the valve pin and onwards into the steam-generating chamber. In view of their relatively small diameters, the bores provided on the valve pin tend to clog easily by contaminants—the provision of substantially larger bores being close to impossible in view of the thickness of the valve pin. An infinitely variable flow control of the first valve is hardly possible.

SUMMARY OF THE INVENTION

Accordingly, it is an object of the present invention to provide a water proportioning device for steam irons which affords ease of construction and economy of manufacture, which can be provided with an infinitely variable control of the amount of steam produced, which can be controlled and cleaned easily and is less prone to clogging.

A water proportioning device of the present invention can be opened and closed simply by turning the valve pin, with the valve pin being held in its respective position by frictional engagement, thereby obviating the necessity for additional arrangements such as the required snap-in locking mechanism of the prior-art devices for locking the valve pin in its individual positions. An infinitely variable control of the amount of water introduced into the steam-generating chamber per unit of time and of the corresponding steam volume produced can be accomplished with the first valve of the present invention in a simple manner. Owing to the cooperative relationship between the transverse groove in the valve pin and the opening in the valve member, a diaphragm is provided whose cross-section of passage is variable by turning the valve pin. By means of this diaphragm, the amount of steam produced is readily adaptable to the particular ironing needs. The adjustment range of the diaphragm is determined by the length of the transverse groove.

By providing for the area of cross-section of the transverse groove to enlarge or increase progressively in the opening direction of the first valve particularly fine metering of water is accomplished with the first valve.

In order to obtain an advantageously wide range of adjustment, the transverse groove suitably extends over a circumferential angle of up to 180 degrees.

The third position is particularly suitable for increasing the generation of steam temporarily without this requiring a variation of the selected steam setting by turning the valve pin. In particular by means of this third position, a burst of steam can be effected in which the amount of steam produced temporarily exceeds the maximum possible amount of steam that can be produced on a continuous basis.

Providing a second longitudinal groove allows a simple valve structure and a dimensioning of the cross-section of passage in the third position of the valve pin which is independent of the remaining valve functions. This configuration has the added advantage that the third position in which extra steam is produced is selectable from any previously set position of the valve pin, that is, from both the first and the second position. In addition, the valve pin may also be movable in an axial direction without adversely affecting the mode of operation of the first valve, for example, in order to thereby enable the second valve to produce a burst of steam. This has no effect on the valve positions selectable by turning the valve pin. The additional valve function can therefore be activated from various positions of the valve pin.

The effective cross-section of passage in the fourth position is dimensioned sufficiently large to cause the amount of water introduced into the steam-generating chamber to effect a self-cleaning action of the jet system. The increased supply of water is readily accomplishable in the fourth position of the valve pin by providing the second longitudinal groove with a section of enlarged cross-section whose both ends lie outside the valve opening on either side only in the fourth position.

In a further development the valve pin is automatically returned from the third and fourth positions.

A particularly simple spring arrangement employs a compression spring that encompasses the actuating end of the valve pin and bears with one end against an operating button and with its other end supported on a housing surface. On the one hand, the compression spring ensures that the first valve is urged into its closed position on release, and on the other hand the compression spring itself is simply guided on the valve pin.

In a particular embodiment, the third and/or fourth position of the valve pin can only be reached by special manipulation or means, that is, the valve is prevented from occupying the third and/or fourth position using a normal rotary motion of the operating button. The latter positions can only be set, for example, by imparting to the valve an additional axial motion when in a predetermined position, in order to enable the valve to move from the normal metering position (regular steam mode) into either the third or the fourth position. It will be understood, however, that such unlocking means may also be provided by other release or locking devices.

The third position of the valve, for example, is understood to be the position that results when the valve pin has been pushed down through its entire travel. The fourth position is then understood to be the position that results when the valve pin has been lifted all the way out of the valve member in upward direction for cleaning purposes. In the latter position, the unlocking means are formed by an aperture as a result of which the valve pin with its projection can be lifted upwardly out of the wall of the iron only when the valve pin is in a predetermined position.

In a second embodiment, the surge-type flow of water into the steam-generating chamber is controlled in that the valve pin is formed by a sleeve in which a second valve is arranged. The valve pin, in cooperation with the valve member, thus performs the normal drip function, while the second valve, substituting the separate longitudinal groove of the first embodiment, controls the surge-type or accelerated flow.

Particular ease of manufacture and assembly is accomplished in a construction, in which the valve rod is inserted into the valve pin from the side where the longitudinal groove and the transverse groove are provided.

Perferably a spring ensures that the second valve is maintained in its closed position.

In order to be able to actuate the valve rod independently of the valve pin, the operating button extends concentrically with the pushbutton, and on actuation the pushbutton will enter the space provided in the interior of the operating button. This arrangement affords particular ease of access and manipulation, obviating the necessity of providing a separate space for the pushbutton.

BRIEF DESCRIPTION OF THE DRAWINGS

An embodiment of the present invention will now be described in more detail in the following with reference to the accompanying drawings. In the drawings.

DESCRIPTION OF PARTICULAR EMBODIMENT

Figure 1:
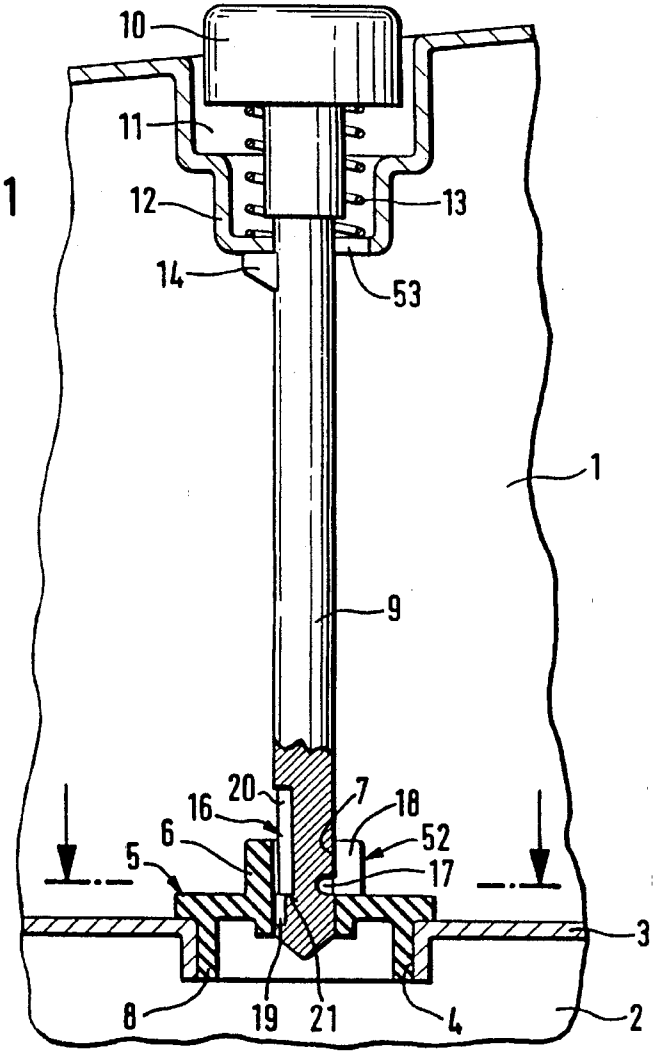
FIG. 1 is a partial cross-sectional view of the water reservoir and the steam-generating chamber of a steam iron provided with the steam-control valve of the present invention, illustrating a first embodiment.
Figure 4:
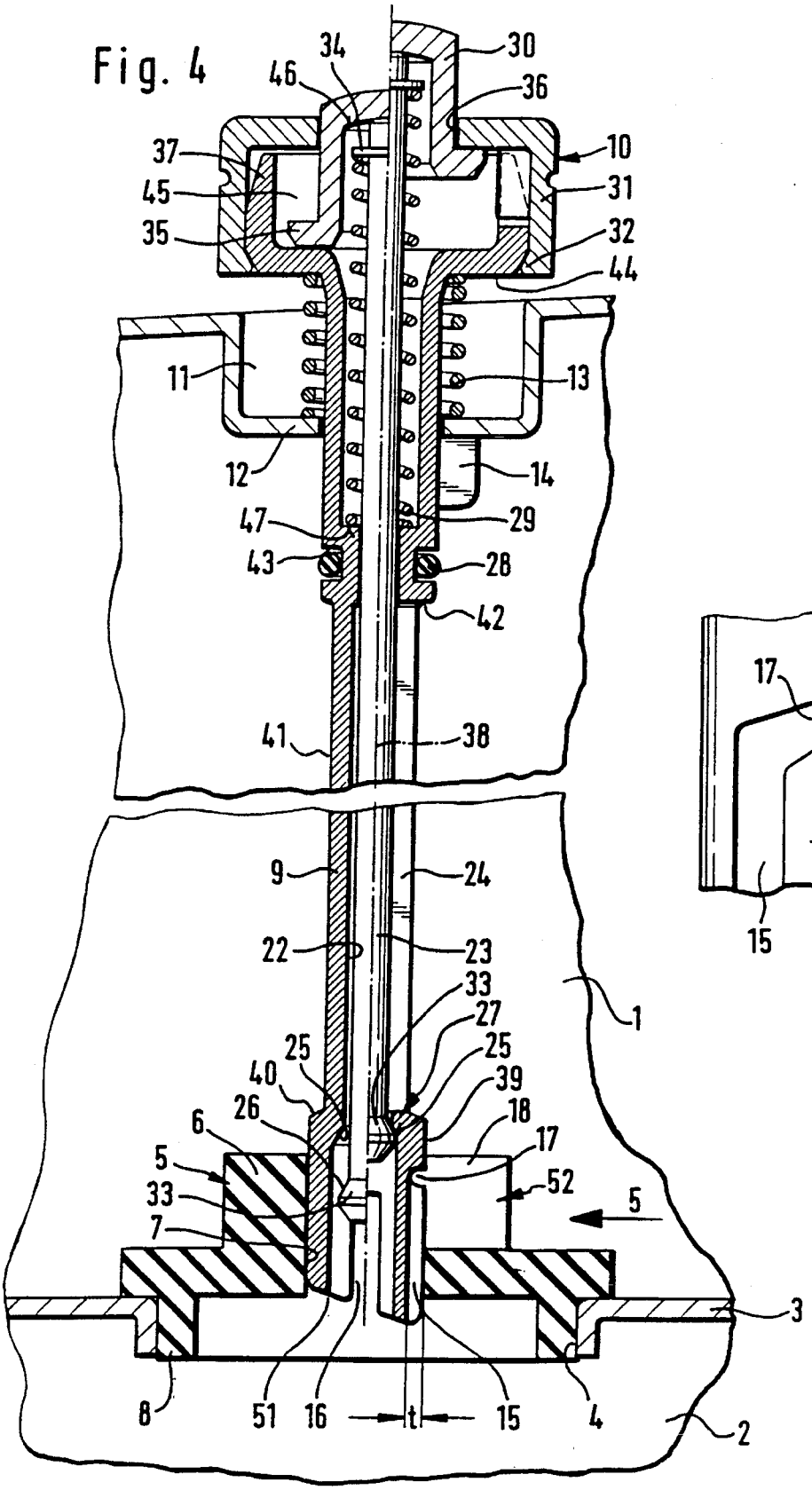
FIG. 4 is a view of a second embodiment of a steam-control valve of the present invention.

FIGS. 1 and 4 show a section of a water reservoir 1 and an underlying steam-generating chamber 2 of a steam iron. The water reservoir 1 and the steam-generating chamber 2 are separated from each other by a wall 3. An opening 4 is provided in the wall 3 in which a valve member 5 is held in sealing engagement. The valve member 5 is made of an elastomer material, having the form of an annular disk with a central valve opening 7 bounded by a cylindrical skirt 6 and with an annular collar 8 adjacent to the disk edge and engaging the opening 4. The valve opening 7 receives the lower end of a cylindrical valve pin 9 sealingly engaged by the skirt 6.

Figure 2:
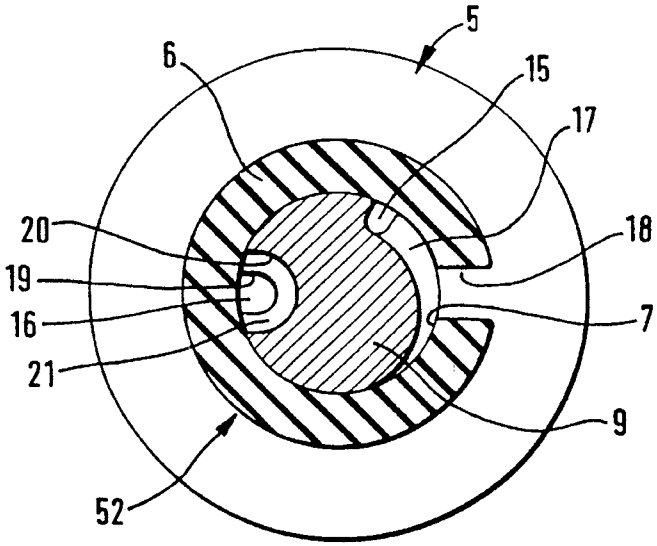
FIG. 2 is a cross-sectional view of the valve of the water proportioning device of FIG. 1.

As shown in FIG. 1, the valve pin 9 which is formed by a solid rod in FIGS. 1 to 3 extends through the water reservoir 1, carrying at its upper end that protrudes from the water reservoir 1 a cylindrical operating button 10 Of increased diameter. The valve pin 9 and the button 10 are formed as an integral part made of a heat-resistant plastic material. The upper end of the valve pin 9 is rotatably received in a stepped bore 11 provided in the wall 12 of the water reservoir 1.

Mounted between the wall 12 and the button 10 is in FIG. 1 a slightly biased compression spring 13 holding the valve pin 9 in the axial position illustrated in FIG. 1, which position is determined by a radially projecting lug 14 formed on the valve pin 9 and abutting the wall 12 on the inside of the water reservoir 1.

Figure 5:
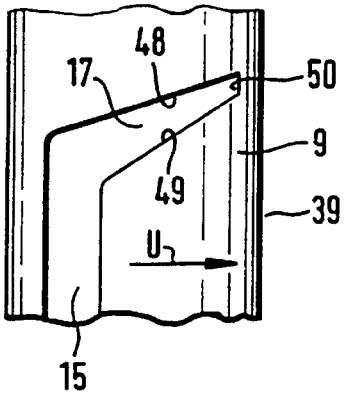
FIG. 5 is a side view of the valve pin in the area of the transverse and the longitudinal groove, in the direction indicated by the arrow 5 of FIG. 4.

To provide controllable valve passageways, the valve pin 9 of FIGS. 1 to 3 has at its lower end two spaced-apart longitudinal grooves 15, 16 and one transverse groove 17. The longitudinal groove 15 extends from the lower end of the valve pin 9 up to an end of the transverse groove 17, its cross-section being constant when viewed in the longitudinal direction. The transverse groove 17 opens into the longitudinal groove 15, extending in the circumferential direction over an angle of about 160 degrees, its area of cross-section decreasing as its distance from the longitudinal groove 15 increases, as shown in FIG. 5.

In the position of the valve pin 9 illustrated in FIG. 1, the transverse groove 17 is in an area of the skirt 6 which includes an opening 18 formed by a radial slot through which the transverse groove 17 is connectible with the interior of the water reservoir 1. The width of the opening 18 is equal to, or slightly greater than, the width of the longitudinal groove 15. The longitudinal groove 16 is on the side of the valve pin 9 opposite the transverse groove 17, approximately in the center between the longitudinal groove 15 and the end of the transverse groove 17.

In FIG. 1, the upper end of the longitudinal groove 16 lies outside the valve opening 7 at such a relative distance to the skirt 6 that the longitudinal groove 16 has its maximum cross-section of passage maintained in communication with the interior of the water reservoir 1 in any position of the valve pin 9. The lower end of the longitudinal groove 16 is spaced apart from the end of the outer cylindrical surface of the valve pin 9, lying inside the valve opening 7 in the position of the valve pin 9 illustrated in FIG. 1. In this position of the valve pin 9, the longitudinal groove 16 is therefore isolated from the steam-generating chamber 2. The longitudinal groove 16 is comprised of a lower section 19 and an upper section 20 interconnected by a short stepped transition 21. The section 19 is of a smaller width and a smaller depth than the section 20. Its cross-sectional area is, however, greater than the cross-sectional area of the longitudinal groove 15. The cross-sectional area of the section 20 is about double the cross-sectional area of the section 19.

In the following, the various settings selectable with the water proportioning device described will be explained with reference to FIG. 3. The individual illustrations a to f of FIG. 3 show the valve member 5 and the valve pin 9 with its operating button 10 at the various possible settings. A top plan view of the button 10 on which indicia are provided illustrates the respective angular position of the valve pin 9.

Figures 3A, 3B, 3C, 3D, 3E, 3F:
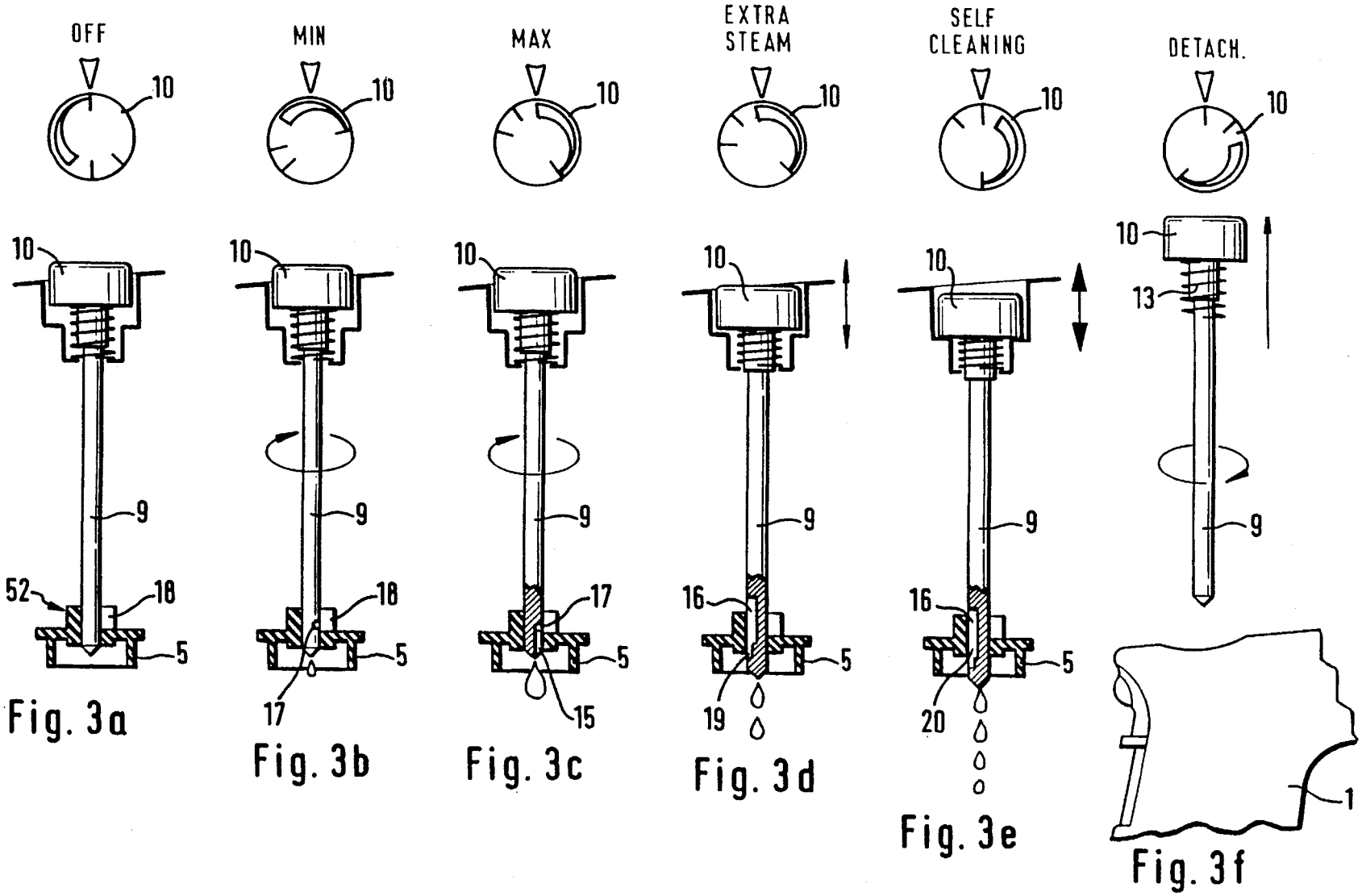
FIG. 3 is a representation of the various valve positions a to f of the water proportioning device of FIG. 1.

In FIG. 3*a*, the valve pin is in its closed position. This position is set when in the representation of FIG. 2 the valve pin 9 is rotated in a counterclockwise direction through about 100 degrees. In this position, the transverse groove 17 is isolated from the opening 18 and closed by the skirt 6. The opening 18 is closed by the circumferential surface of the valve pin 9. The lower end of the longitudinal groove 16 is inside the skirt 6, being accordingly equally closed.

Starting from the closed position shown in FIG. 3*a*, the valve is opened by turning the operating knob 10 in a clockwise direction. As a result, the transverse groove 17 overlies the opening 18, enabling water to flow from the water reservoir 1 through the transverse groove 17 and the longitudinal groove 15 into the steam-generating chamber 2. Such an open position is shown in FIG. 3*b* and in FIG. 2. In this position, the amount of flow is determined by the respective area of cross-section of the transverse groove 17 communicating with the opening 18. When it is desired to increase the amount of flow, the operating button 10 is turned in a clockwise direction, whereas it is turned counterclockwise to obtain a reduced flow.

The maximum amount of flow and thus the maximum steam level provided for a continuous supply of steam is set when the end of the transverse groove 17 connected with the longitudinal groove 15 is directly in front of the opening 18, as a result of which the full cross-section of passage of the longitudinal groove 15 is made available to the water for discharge into the steam-generating chamber 2. This position is reflected in FIG. 3*c*.

When it is desired to generate an amount of steam exceeding the amount limited by the longitudinal groove 15, this can be accomplished by pushing the operating button 10 down, as shown in FIG. 3*d*. As this occurs, the valve pin 9 is displaced axially, causing the lower section 19 of the longitudinal groove 16 to protrude from the valve opening 7 so that communication is established between the water reservoir 1 and the steam-generating chamber 2. The cross-sectional area of the section 19 which is greater than that of the longitudinal groove 15 and the transverse groove 17 allows a correspondingly higher amount of water to be discharged per unit of time, thus effecting an increased development of steam in the manner of a burst of steam.

To ensure that on depression of the operating button 10 the valve pin 9 occupies the proper axial position without traveling too far downwards, stop means not shown in greater detail are provided on the operating button 10 for limiting the axial travel of the operating button 10. The stop means may be configured such that the button 10 can be pushed down only in selected positions, for example, when set to the range in which there is a continuous supply of steam metered by means of the transverse groove 17.

By displacing the valve pin 9 as shown in FIG. 3*d*, the transverse groove 17 and the longitudinal groove 15 are caused to leave the area of communication with the opening 18, being therefore closed. This has the advantage that the amount discharged on pressing down the button 10 is independent of the particular position of the valve pin 9. As an alternative, the possibility also exists to arrange the transverse groove 17 and the end of the longitudinal groove 15 connected therewith at such an elevation in the upper area of the skirt 6 that the flow path therethrough is maintained open also after the button 10 is pressed down.

The upper section 20 of the longitudinal groove 16 provided for self-cleaning of the iron can be put to effect only in the position of the operating button 10 shown in FIG. 3*e*. In this position in which the valve is initially closed, the button 10 can be pushed deep into the bore 11, such that the lower end of the upper section 20 of the longitudinal groove 16 exits from the valve opening 7, thereby enabling a comparatively large amount of water to enter the steam-generating chamber 2. With the correspondingly large amounts of steam developing in the process, solid particles are flushed through the steam vents in the soleplate.

The button 10 is pressed down in opposition to the force of the compression spring 13 which is compressed in the process. For the duration of actuation, it is thus necessary for the button to be held in pressed-down position. After it is released, the compression spring 13 returns the button 10 and the valve pin 9 to the initial position.

In order to be able to remove mineral deposits from the longitudinal grooves 15, 16 and the transverse groove 17, the valve pin 9, together with its operating button 10 and the compression spring 13, is detachable from the water reservoir 1 of the steam iron in the position illustrated in FIG. 3*f*. For this purpose, the wall 12 has in the area of the abutment surface for the lug 14 an aperture 37 enabling the lug 14 to pass therethrough.

FIG. 4 illustrates a second embodiment of a water proportioning device wherein like reference numerals designate like parts to avoid repetitions. For the sake of simplicity, only the aspects that differ from the water proportioning device of FIGS. 1 to 3 will be set out in this embodiment.

In FIG. 4, the valve pin 9 is comprised of a tubular body extending along its full length and having at its lower end the longitudinal and transverse groove 15 and 17, respectively, previously mentioned with reference to FIGS. 1 to 3. To provide a tubular body, the valve pin 9 includes a longitudinal bore 22 in which a valve rod 23 is arranged having at its lower end an enlarged portion 33 providing a valve surface 26. The valve surface 26 is adapted to engage a valve seat 25 formed on a shoulder in the longitudinal bore 22 when the second valve 27 thus formed occupies its closed position. In FIG. 4, the part to the left of the center line 38 shows the second valve 27 in its open position, while the part to the right of the center line 38 shows it in its closed position.

As can be further seen from FIG. 4, the water proportioning device is illustrated in one of several possible open positions because the transverse groove 17 is within the opening 18 while at the same time the longitudinal groove 15 establishes a connection from the interior of the water reservoir 1 to the steam-generating chamber 2 provided below the valve member 5. The transverse and longitudinal grooves 17 and 15, respectively, are formed on an increased-diameter section 39 continuing through an annular shoulder 40 upwardly in a reduced-diameter section 41. Provided on the reduced-diameter section 41 is an aperture 24 extending approximately from the annular shoulder 40 upwardly to a further annular shoulder 42 of increased diameter. Adjoining the annular shoulder 42 in upward direction is an annular groove 43 receiving an O-ring 28 therein. The O-ring 28 serves as a seal relative to a bore provided in the water reservoir 1 to prevent leakage of water from the water reservoir 1. While the bore is not shown in the drawing, it is apertured in the area of the lug 14, the bore serving to improve the guiding of the valve pin 9.

According to FIG. 4, the valve pin 9 extends through the wall 12, terminating in a cup-shaped enlargement 37 which is upwardly open and is closed by a cap 31 using a snap fitting 32 between the cap 31 and the enlargement 37. The enlargement 37 provides an annular shoulder 44 against which one end of the compression spring 13 bears. With its other end, the compression spring 13 takes support upon the wall 12. The compression spring 13 surrounds the valve pin 9 concentrically and is guided by it laterally. The compression spring 13 serves to ensure that the valve pin 9 with its projection or lug 14 is at all times in clearance-free engagement with the wall 12 formed fast with the housing.

In the chamber 45 defined by the enlargement 37 and the cap 31, a pushbutton 30 is received projecting outwardly through a bore 36 formed in the cap 31. The pushbutton 30 includes a radially enlarging annular collar 35 serving a stop function on the inner wall of the cap 31 in the inoperative condition of the pushbutton 30. Resting without clearance against the bottom 46 of the pushbutton 30 is the valve rod 23 which, acted upon by the force of the spring 29, ensures that the pushbutton 30 is in resilient abutment in the initial position illustrated to the right of the center line 38. Inside the longitudinal bore 22, the spring 29 bears with one end against a shoulder 47, while the other end of the spring takes support upon a retaining ring 34 secured to the valve rod 23 and serving a stop function. It is thereby ensured that in the inoperative condition the valve rod 23 is held in its initial position illustrated to the right of the center line 38, which is the closed position of the second valve 27.

The mode of operation of the water proportioning device of FIG. 4 is as follows:

With the water proportioning device in the closed position, the transverse groove 17 and thus also the longitudinal groove 15 are outside the opening 18, the skirt 6 thus closing the transverse and longitudinal groove 17 and 15, respectively, so that fluid communication does not exist between the water reservoir 1 and the steam-generating chamber 2, preventing water from dripping into the steam-generating chamber 2. In this closed position, the second valve 27 is openable at any time, for example, to produce a sudden burst of steam, which is accomplished by pushing the pushbutton 23 down against the force of the spring 29, causing the valve rod 23 to move downwardly together with its enlarged portion, as a result of which the valve surface 26 is lifted clear of the valve seat 25. Water is then allowed to flow through the aperture 24 into the longitudinal bore 22 and onwards into the steam-generating chamber 2. When the pushbutton 30 is released, the force of the spring 29 returns the valve rod 23 back into its closed position illustrated to the right of the center line 38. The valve 27 is closed again, preventing water from entering the steam-generating chamber 2 in a surge.

In order to obtain during a normal ironing operation in addition to the burst of steam also a continuous and constant delivery of steam through the steam vents (not shown) provided in the soleplate, it is possible, by turning the cap 31 and thus the valve pin 9, to turn the valve pin without axial displacement in its longitudinal direction until the transverse groove 17 extends or engages in the opening 18, allowing water to drip through the transverse groove 17 to the longitudinal groove 15 and onwards into the steam-generating chamber 2. Because the transverse groove 17 widens in the direction of the longitudinal groove 15 as is clearly shown in FIG. 5, further turning of the valve pin 9 enables the surface portion of the transverse groove 17 projecting into the opening 18 to be increased, thereby equally increasing the cross-section of passage of the drip valve.

FIG. 5 shows on an enlarged scale the arrangement of the transverse and longitudinal groove 17 and 15, respectively, the transverse and longitudinal groove 17, 15 being comprised of a groove provided on the outer surface of the increased-diameter section 39. The upper edge 48 and the lower edge 49 extend in a converging fashion in the circumferential direction U of the section 39 until they meet in the end portion 50. Accordingly, with the valve open a minimum amount, only the end portion 50 projects into the opening 18. The more the transverse groove 17 is turned into the opening 18 by rotation of the valve pin 9, the greater the cross-section of passage becomes through which water is allowed to flow from the transverse groove 17 to the longitudinal groove 15, to be discharged into the steam-generating chamber 2. The amount of water passing through the first valve 52 can be predetermined by predetermining the depth t of the transverse and longitudinal groove 17 and 15, respectively.

In the event of the water proportioning device being clogged in the area of the transverse or longitudinal groove 17, 15, the valve pin 9 is simply pulled out together with the valve rod 23 so that the transverse and longitudinal groove 17, 15 can be readily cleaned from outside. To this end, the valve pin 9 is turned until the lug 14 reaches an aperture (not shown) provided in the wall 12 through which the valve pin 9 can then be withdrawn in upward direction. For subsequent replacement of the valve pin 9, a chamfer 51 is provided to facilitate insertion of the valve pin 9 into the valve opening 7 of the elastomer valve member 5.

What is claimed is:

1. A water proportioning device for steam irons comprising water reservoir structure, steam-generating chamber structure, a first valve arranged between said water reservoir structure and said steam-generating chamber structure, said first valve including a valve member having skirt structure and a valve opening and valve pin structure in sealing engagement within said valve opening, said skirt structure encompassing said valve pin structure, said valve pin structure having a longitudinal groove that has two ends and a transverse groove at one end of said longitudinal groove, said valve pin structure being movable between a first position closing said valve opening and a second position in which said two ends of said longitudinal groove are open on either side of said valve opening, said valve pin structure being movable by rotary motion within said valve opening between a closed position and an open position and vice versa, said transverse groove extending circumferentially in an area of said valve pin structure lying in said valve opening such as to extend within the height of said skirt structure, and said transverse groove being in communication with said opening in said skirt structure to a greater or lesser extent, depending on the open position of said first valve.

2. The water proportioning device of claim 1 wherein the cross-sectional area of said transverse groove decreases as its distance from said longitudinal groove increases.

3. The water proportioning device of claim 2 wherein said transverse groove extends over a circumferential angle of up to 180°.

4. The water proportioning device of claim 1 wherein said valve pin structure has an additional passageway and said valve pin structure is axially movable into a third position in which said additional passageway is open between said water reservoir structure and said steam-generating chamber structure.

5. The water proportioning device of claim 4 wherein said valve pin structure has on its side remote from said transverse groove a second longitudinal groove which, with said valve pin structure in said first and said second position, has one end thereof within said valve opening of said valve member, both ends of said second groove lying outside said valve opening on either side in said third position reachable by axial motion of said valve pin structure.

6. The water proportioning device of claim 4 wherein said valve pin structure is axially movable beyond said third position into a fourth position, with the effective cross-section of said additional passageway in said fourth position being greater than the effective cross-section of said additional passageway in said third position.

7. The water proportioning device of claim 6 wherein said second longitudinal groove is provided with a section of enlarged cross-section whose both ends lie outside said valve opening on either side only in said fourth position.

8. The water proportioning device of claim 6 wherein structure is provided allowing movement of said valve pin structure into said third or fourth position only when said valve pin structure is in a predetermined angular position.

9. The water proportioning device of claim 8 and further including an operating button fixedly connected with said valve pin structure, and housing structure in which said valve pin structure is disposed, and wherein said housing structure includes an abutment and said operating button includes a projection cooperating with said abutment for limiting the axial motion of said operating button in said third position, said abutment having an aperture in a predetermined area in which said projection is capable of entering on axial motion of said operating button.

10. The water proportioning device of claim 1 and further including a spring adapted to be biased by axial motion of said valve pin structure and wherein said valve pin structure is supported on said spring.

11. The water proportioning device of claim 10 and further including an operating button fixedly connected with said valve pin structure, and housing structure in which said valve pin structure is disposed, and wherein said spring is a compression spring that encompasses the actuating end of said valve pin structure and bears with one end against said operating button while its other end is supported on a surface of said housing structure.

12. The water proportioning device of claim 1 wherein said valve pin structure in a particular angular position is detachable from said water reservoir structure.

13. The water proportioning device of claim 1 wherein said valve pin structure includes a longitudinal bore, said longitudinal bore is connected with said water reservoir structure through an aperture, and further including a valve rod received in said longitudinal bore and extending longitudinally of said valve pin structure, said valve rod, together with said valve pin structure, forming a second valve adjacent said valve member.

14. The water proportioning device of claim 13 wherein said second valve includes valve seat structure formed in said longitudinal bore and a valve surface provided on an enlarged portion of said valve rod.

15. The water proportioning device of claim 14 wherein said valve pin structure and said valve rod include stop structures, and further including spring structure for holding said second valve in closed position, said spring structure being supported on said stop structures.

16. The water proportioning device of claim 14 and further including an operating button fixedly connected with said valve pin structure, and housing structure in which said valve pin structure is disposed, and a pushbutton, and wherein said operating button receives slidably therein said pushbutton against which said valve rod bears, said pushbutton extending through a bore in said operating button, and said pushbutton including an annular collar abutting against the inside of said operating button when said second valve is in closed position.

17. The water proportioning device of claim 16 and further including a cup-shaped enlargement and snap fitting structure at the end of said valve pin structure and said operating button includes cap structure connected to said cup-shaped enlargement through said snap fitting structure.

* * * * *

UNITED STATES PATENT AND TRADEMARK OFFICE

CERTIFICATE OF CORRECTION

PATENT NO. : 5,531,037

DATED : July 2, 1996

INVENTOR(S) : Francesc Pons, et al.

It is certified that error appears in the above-identified patent and that said Letters Patent is hereby corrected as shown below: On the title page:

Section [56], under U.S. PATENT DOCUMENTS, please delete "Willman" and insert --Williams, et al.--;

Section [56], under FOREIGN PATENT DOCUMENTS, please add the following references:

| | | | |
|---|---|---|---|
| -- | 146,314 | 09/1979 | East Germany |
| | 1,585,764 | 05/1966 | W. Germany |
| | 2701047 | 01/1977 | W. Germany |
| | D3212327A1 | 04/1982 | W. Germany |
| | D3405465A1 | 02/1984 | W. Germany --. |

Signed and Sealed this

Sixth Day of January, 1998

*Attest:*

BRUCE LEHMAN

*Attesting Officer*

*Commissioner of Patents and Trademarks*